US010753332B2

(12) United States Patent
Duru

(10) Patent No.: US 10,753,332 B2
(45) Date of Patent: Aug. 25, 2020

(54) FUEL INJECTOR HAVING A THROTTLE ELEMENT

(71) Applicant: Robert Bosch GmbH, Stuttgart (DE)

(72) Inventor: Buenyamin Duru, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/103,957

(22) PCT Filed: Oct. 10, 2014

(86) PCT No.: PCT/EP2014/071771

§ 371 (c)(1),
(2) Date: Jun. 13, 2016

(87) PCT Pub. No.: WO2015/086192

PCT Pub. Date: Jun. 18, 2015

(65) Prior Publication Data

US 2016/0319794 A1 Nov. 3, 2016

(30) Foreign Application Priority Data

Dec. 13, 2013 (DE) ..... 10 2013 225 834

(51) Int. Cl.
*F02M 61/20* (2006.01)
*F02M 51/06* (2006.01)
*F02M 61/16* (2006.01)

(52) U.S. Cl.
CPC ..... *F02M 61/205* (2013.01); *F02M 51/0685* (2013.01); *F02M 61/165* (2013.01); *F02M 2200/28* (2013.01); *F02M 2200/315* (2013.01)

(58) Field of Classification Search
CPC ..... F02M 61/205; F02M 61/165; F02M 51/0685; F02M 2200/28; F02M 2200/315
See application file for complete search history.

(56) References Cited

U.S. PATENT DOCUMENTS 3,499,605 A * 3/1970 Dreisin ..... F02M 61/10 138/43
5,165,656 A * 11/1992 Maier ..... F02M 51/0682 239/585.4

(Continued)

FOREIGN PATENT DOCUMENTS

CN 1462338 A 12/2013
DE 4003228 A1 8/1991

(Continued)

*Primary Examiner* — David Hamaoui
(74) *Attorney, Agent, or Firm* — Norton Rose Fulbright US LLP; Gerard Messina

(57) ABSTRACT

A fuel injector for fuel injection systems of internal combustion engines, in particular for direct injection of fuel into the combustion chamber of an internal combustion engine, is described, including a solenoid, an armature, which is acted upon by the solenoid in a closing direction by a return spring, and a valve needle, which is connected to the armature in a force-locked manner for actuation of a valve closing body, which together with a valve face forms a sealing seat. An adjusting element for adjusting the spring force of the return spring is situated in a connector sleeve which provides the fuel feed on the inlet side. The adjusting element is delimited toward the outside by a thin-walled sleeve, into which a disk-shaped throttle element having a throttle borehole is introduced as a separate insert part.

11 Claims, 4 Drawing Sheets

(56) References Cited

U.S. PATENT DOCUMENTS 5,335,863 A * 8/1994 DeGrace ..... F02M 51/0671 239/575
5,641,126 A * 6/1997 Nally ..... F02M 61/145 239/575
5,979,866 A * 11/1999 Baxter ..... F02M 51/0639 137/550
6,328,232 B1 * 12/2001 Haltiner, Jr. ..... F02M 51/0614 239/533.2
6,434,822 B1 * 8/2002 Perry ..... F02M 51/0667 219/121.63
6,648,247 B2 * 11/2003 McFarland ..... F02M 51/005 239/533.6
6,997,404 B2 * 2/2006 Rao ..... F02M 51/0667 239/533.12
7,070,127 B2 * 7/2006 Maier ..... F02M 51/0671 239/533.11
7,429,006 B2 * 9/2008 Dallmeyer ..... F02M 51/005 239/585.1
7,617,991 B2 * 11/2009 Wells ..... F02M 61/165 239/5
7,770,812 B2 * 8/2010 Sebastian ..... F02M 51/0667 210/429
2003/0052052 A1 * 3/2003 Boast ..... F02M 51/0667 210/429
2003/0094513 A1 * 5/2003 Luft ..... F02M 51/0671 239/533.9

FOREIGN PATENT DOCUMENTS

| | | | |
|---|---|---|---|
| DE | 4131535 | A1 | 3/1993 |
| DE | 102009000183 | A1 | 7/2010 |
| EP | 1229239 | A2 | 8/2002 |
| EP | 1296057 | B1 | 3/2003 |
| EP | 1377747 | A1 | 1/2004 |
| EP | 1741925 | A1 | 1/2007 |
| EP | 2000662 | A1 | 12/2008 |
| EP | 2426351 | A1 | 3/2012 |
| JP | 2002130088 | A | 5/2002 |
| WO | WO0210583 | A1 | 2/2002 |

* cited by examiner

FUEL INJECTOR HAVING A THROTTLE ELEMENT

FIELD

The present invention is directed to a fuel injector.

BACKGROUND INFORMATION

German Patent No. DE 40 03 228 A1 describes a fuel injector in which a fuel filter on the inlet end of the fuel injector is pressed into the fuel inlet port. On the circumference, this fuel filter is provided with a brass ring, for example, which forms the pairing together with the wall of the fuel inlet port when the fuel filter is pressed into place. The brass ring surrounds a ring-shaped solid plastic section of the base body of the fuel filter, from which three webs, for example, extend in the longitudinal direction up to a common bottom section, the actual filter screen being extrusion coated in these subareas. An adjusting sleeve downstream from the fuel filter acts to adjust the spring pre-load of a return spring in contact with the adjusting sleeve.

In addition, some conventional fuel injectors include the adjusting sleeve and the fuel filter as a so-called combination part, i.e., the two functions of adjustment of the spring pre-load of a return spring in contact with the adjusting sleeve and filtering of the inflowing fuel are integrated into one part (as described in U.S. Pat. Nos. 5,335,863 A, and 6,434,822 B1, and European Patent Nos. EP 1 296 057 B1, EP 2 426 351 A1, EP 1 377 747 A1). All of the conventional approaches are characterized in that a press area is provided in the area of the adjusting sleeve and enters into a press fit with the wall of the connecting nozzle surrounding it, and this press fit is chosen to be so tight that the spring tension remains constant over the service life of the fuel injector, i.e., there is no slippage of the adjusting sleeve.

SUMMARY

A fuel injector in accordance with the present invention may have the advantage that an adjusting element is inserted as a combination part into the fuel inlet, which combines a high function integration (adjusting the spring force of the return spring, filtering the fuel, attenuation of pressure pulses), the adjusting element being formed by a sleeve toward the outside, which is able to accommodate multiple inserts in its interior and enclose them reliably and in a protected form.

A substantial noise reduction in comparison with fuel injectors of a similar design and comparable structural embodiment is achievable with very little additional cost and is also easy to manufacture due to the introduction of a disk-shaped throttle element having an integrated throttle borehole in the adjusting element.

Advantageous refinements of and improvements on the fuel injector are described below.

A spring guide may be integrated directly and advantageously and without requiring any additional components in a particularly simple and inexpensive manner in the manufacture of the sleeve of the adjusting element. The costs of the manufacture of the adjusting element may be minimized in this way. The internal geometries of the internal pole and the connector sleeve may be manufactured in a simplified manner. The tolerance requirements may be reduced. The spring guide, which is integrated into the adjusting element according to the present invention, also has the advantage that wear in the internal pole borehole is greatly reduced in comparison with spring guides situated directly in the internal pole.

Furthermore, a filter element is ideally situated in the adjusting element, so that the greatest possible function integration on the adjusting element according to the present invention is provided.

BRIEF DESCRIPTION OF THE DRAWINGS

Exemplary embodiments of the present invention are depicted in simplified form in the figures and explained in greater detail below.

DETAILED DESCRIPTION OF EXAMPLE EMBODIMENTS

Before the exemplary embodiments of a fuel injector according to the present invention are described in greater detail below with reference to FIGS. 2 through 4, a conventional fuel injector is described briefly with respect to its main components based on to FIG. 1 for a better understanding of the present invention.

Figure 1:
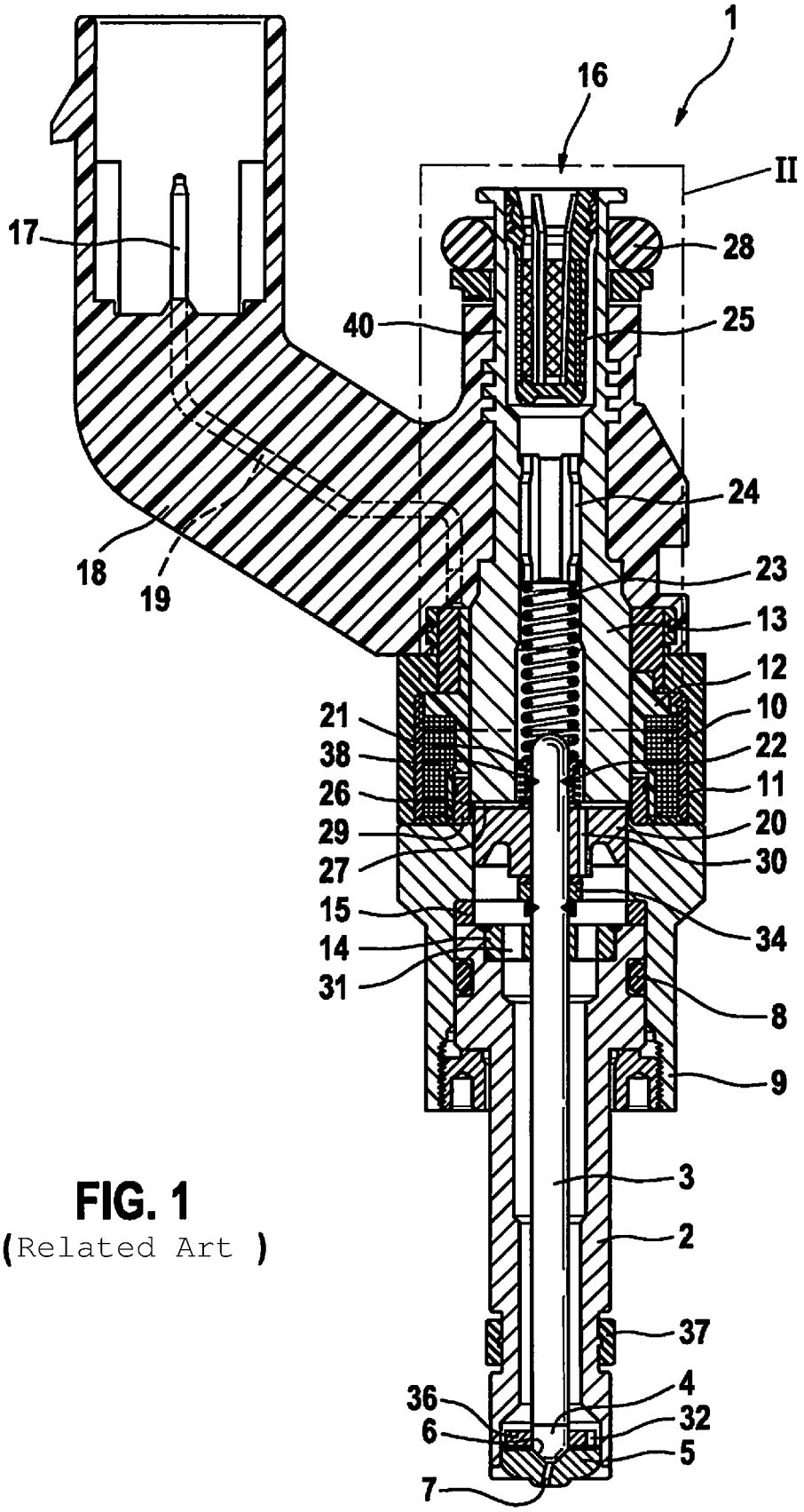
FIG. 1 (Related Art )
FIG. 1 shows an axial section through a fuel injector according to the related art.

Fuel injector 1 shown in FIG. 1 is designed in the form of a fuel injector 1 for fuel injection systems of mixture-compressing, spark-ignition internal combustion engines. Fuel injector 1 is suitable in particular for direct injection of fuel into a combustion chamber (not shown) of an internal combustion engine.

Fuel injector 1 includes a nozzle body 2, in which a valve needle 3 is situated. Valve needle 3 is operatively connected to a valve closing body 4, which cooperates with a valve face 6 situated on a valve seat body 5 to form a sealing seat. Fuel injector 1 in the exemplary embodiment is an inwardly opening fuel injector 1 which has at least one ejection opening 7.

Nozzle body 2 is sealed by a seal 8 against an external pole 9 of a solenoid 10. Solenoid 10 is encapsulated in a coil housing 11 and wound onto a coil carrier 12, which is in contact with an internal pole 13 of solenoid 10. Internal pole 13 and external pole 9 are separated from one another by a constriction 26 and are connected to one another by a nonferromagnetic connecting part 29. Solenoid 10 is energized by an electric current, which may be supplied via an electrical plug contact 17 via a line 19. Plug contact 17 is enclosed in a plastic sheath 18, which may be injection-molded on internal pole 13.

Valve needle 3 is guided in a valve needle guide 14 which is designed in the form of a disk. A paired adjustment disk 15 is used to adjust the lift. Upstream from adjustment disk 15 there is an armature 20. The armature is connected in a force-locked manner via a first flange 21 to valve needle 3, which is joined to first flange 21 by a weld 22. A return spring 23, which is pre-loaded by an adjusting sleeve 24 in the present design of fuel injector 1, is supported on first flange 21.

Fuel channels 30, 31 and 32 run in upper valve needle guide 14, in armature 20 and on a lower guide element 36. Fuel is supplied via a central fuel feed 16 and filtered through a filter element 25. Fuel injector 1 is sealed against a fuel distribution line (not shown here) by one seal 28 and against a cylinder head (not shown here) by another seal 37. Between first flange 21 and armature 20, there is a pre-lift spring 38, which holds armature 20 in contact with second flange 34 in the nonoperating state of fuel injector 1. The spring constant of pre-lift spring 38 here is much smaller than the spring constant of return spring 23.

In the nonoperating state of fuel injector 1, armature 20 is acted upon by return spring 23 and pre-lift spring 38 against its lift direction, so that valve closing body 4 is held in sealing contact with valve face 6. When solenoid 10 is energized, it builds up a magnetic field, which moves armature 20 initially in the lift direction, against the spring force of pre-lift spring 38, an armature clearance being predefined by the distance between first flange 21 and armature 20. After passing through the armature clearance, armature 20 also entrains first flange 21, which is welded to valve needle 3 against the spring force of return spring 23, in the lift direction. Armature 20 passes through a total lift which corresponds to the height of working gap 27 between armature 20 and internal pole 13. Valve closing body 4, which is connected to valve needle 3, is lifted up from valve face 6, and the fuel which is guided through fuel channels 30 through 32 is injected through ejection opening 7.

When the coil current is turned off, armature 20 falls away from internal pole 13 due to the pressure of return spring 23 after sufficient decay of the magnetic field, so that first flange 21, which is connected to valve needle 3, moves against the lift direction. Valve needle 3 is thereby moved in the same direction, so that valve closing body 4 is seated on valve face 6 and fuel injector 1 is closed. Pre-lift spring 38 then in turn acts upon armature 20 in such a way that it does not recoil from second flange 34 but instead returns to the resting state without a stop impact.

Internal pole 13 is designed in the form of a sleeve toward the inlet end of fuel injector 1 and in this respect forms a connector sleeve 40 in this area. Connector sleeve 40 may also be shaped as a separate part independently of internal pole 13, into which internal pole 13 is then fitted. Filter element 25 is inserted in the area of connector sleeve 40. This filter element is used to filter out such particles in the fuel, which could otherwise result in adverse effects on the relevant valve components, such as the sealing seat.

The electromagnetic circuit may be replaced by a piezoelectric actuator or a magnetostrictive actuator, for example.

Figure 2:
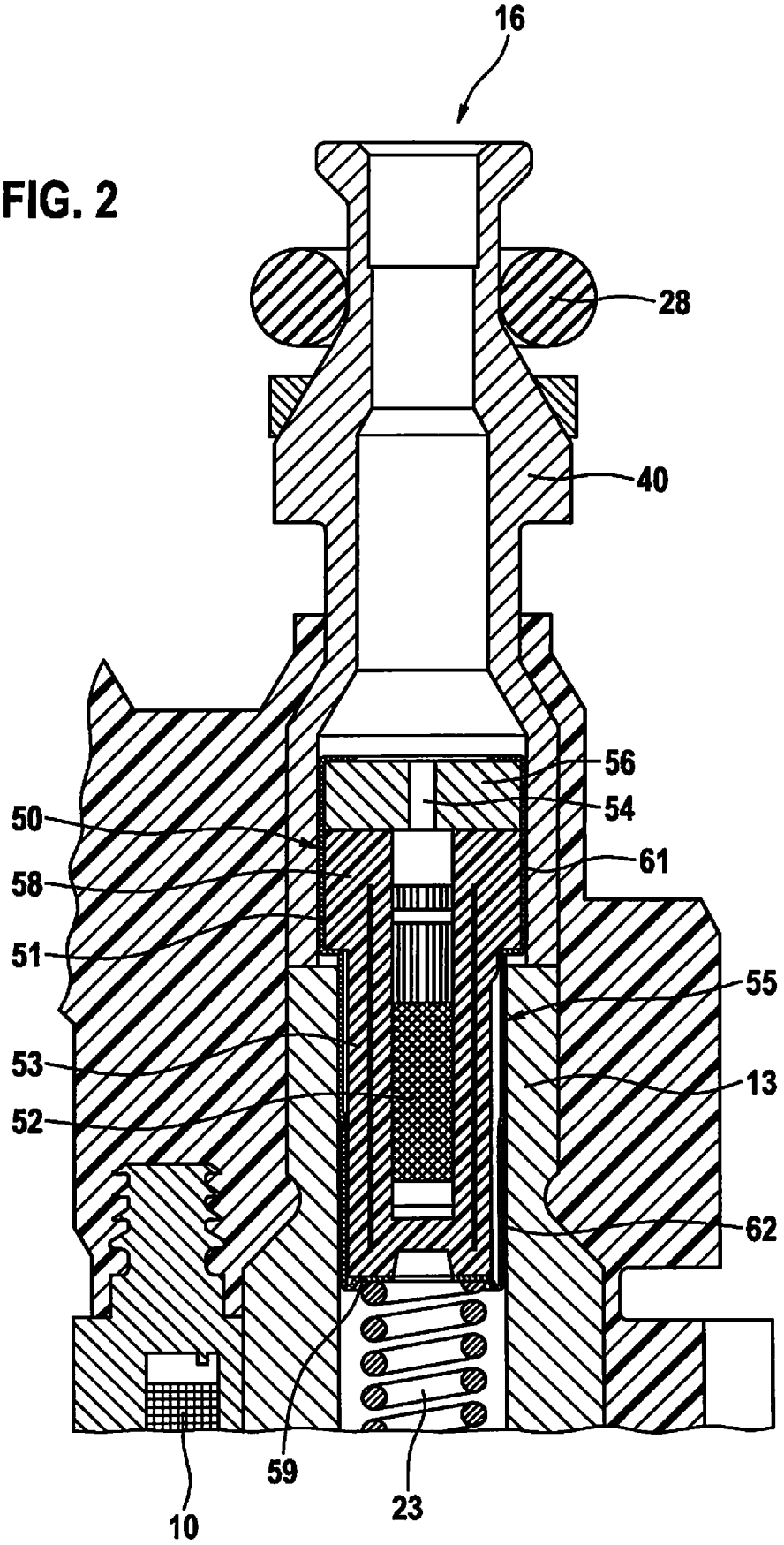
FIG. 2 shows an enlarged detail of the fuel injector shown in FIG. 1 in area II of an embodiment of the adjusting element according to the present invention.

FIG. 2 shows in part in an axial sectional view the detail labeled as II in FIG. 1 as an exemplary embodiment according to the present invention of an adjusting element 50, which is designed as a combination part and at least combines the functions of adjusting sleeve 24 and a filter element 25. Adjusting element 50 again includes multiple individual parts. The outer sheath of adjusting element 50 thus forms a metal sleeve 51, which is designed having multiple steps and is manufactured with the aid of deep drawing. Thin-walled sleeve 51 has a radially enlarged area 61, for example, in a section on the inlet side which represents the area of adjusting element 50 having the largest diameter. In the axial direction, this is followed by an area of a smaller diameter, which functions as pressing area 55. The axially next section on the outflow side is that area 62 of adjusting element 50 having the smallest diameter, which, however, is only slightly smaller in the outside diameter than pressing area 55.

A screen basket 53 made of injection-molded plastic which forms the base body of an integrated filter, is provided in deep-drawn sleeve 51. The plastic of screen basket 53 is preferably an organic high-temperature-resistant thermoplastic polymer, such as polyether ether ketone (PEEK) or polyphenylene sulfide (PPS) or polyamide (PA) and/or polyphthalamide (PPA). Screen basket 53 is ideally manufactured by injection molding of plastic. A filter cloth 52 is introduced as a filter element into the interior of the plastic base body of adjusting element 50 and may also be inserted as an insert into the mold in the plastic injection molding operation. This tubular filter cloth 52 may be made of PEEK or preferably made of a metallic mesh material, which ensures an additional supportive effect and an increased robustness of screen basket 53. Screen basket 53 of the filter has an upper receiving area 58 of an enlarged diameter, which may be inserted suitably into the radially enlarged area 61 of sleeve 51 in a form-fitting manner, preventing screen basket 53 from slipping inside sleeve 51. Screen basket 53 also largely fills out the interior of sleeve 51 over the other areas 55, 62, screen basket 53 being supportable on a bottom area 59 of sleeve 51 on its outflow end. Screen basket 53 is formed by multiple, at least two, web-type support parts of the filter base body.

In particular, in the case of high-pressure injectors, which are supplied with a fuel pressure of >100 bar, for example, it has been found that during operation there may be a substantial noise emission, which may be perceived as unpleasant. Effective noise reduction is achieved by providing a throttle borehole 54 in the inlet area of adjusting element 50, which has an opening cross section that is multiple times smaller than the opening cross section of connector sleeve 40 and of internal pole 13. Throttle borehole 54 has a diameter of 0.4 mm to 1.5 mm, for example, depending on the opening width of connector sleeve 40. With the aid of throttle borehole 54, a targeted attenuation of pressure pulsations may be achieved in the interior of the fuel injector. According to the present invention, throttle borehole 54 is introduced into an independent insert, which is designed as a disk-shaped throttle element 56 and is placed in screen basket 53 on its inlet front side. Throttle element 56 is also accommodated in this respect in radially enlarged area 61 of thin-walled sleeve 51. For secure accommodation of throttle element 56, sleeve 51 is flanged above throttle element 56, so that a ring collar 65 of sleeve 51 partially covers throttle element 56. Throttle element 56 is introduced into sleeve 51, in particular in inlet area 61, where it sits so tightly that the edge area is sealed to the extent that any bypass to throttle borehole 54 is prevented.

The lower outflow end of adjusting element 50 is formed by bottom area 59 of deep-drawn sleeve 51; this area may have means such as cantilevers or journals for integrated guidance of return spring 23.

During the assembly operation, adjusting element 50 is guided into internal pole 13, return spring 23 ultimately being set at a desired pre-press amount over pressing area 55. During the assembly of connector sleeve 40, connector sleeve 40 is pushed over the protruding upper end of adjusting element 50. After this assembly and after welding connector sleeve 40 on internal pole 13, the dynamic ejection quantity and the spring force of return spring 23 may ultimately be set permanently by shifting the adjusting element 50.

Figure 3:
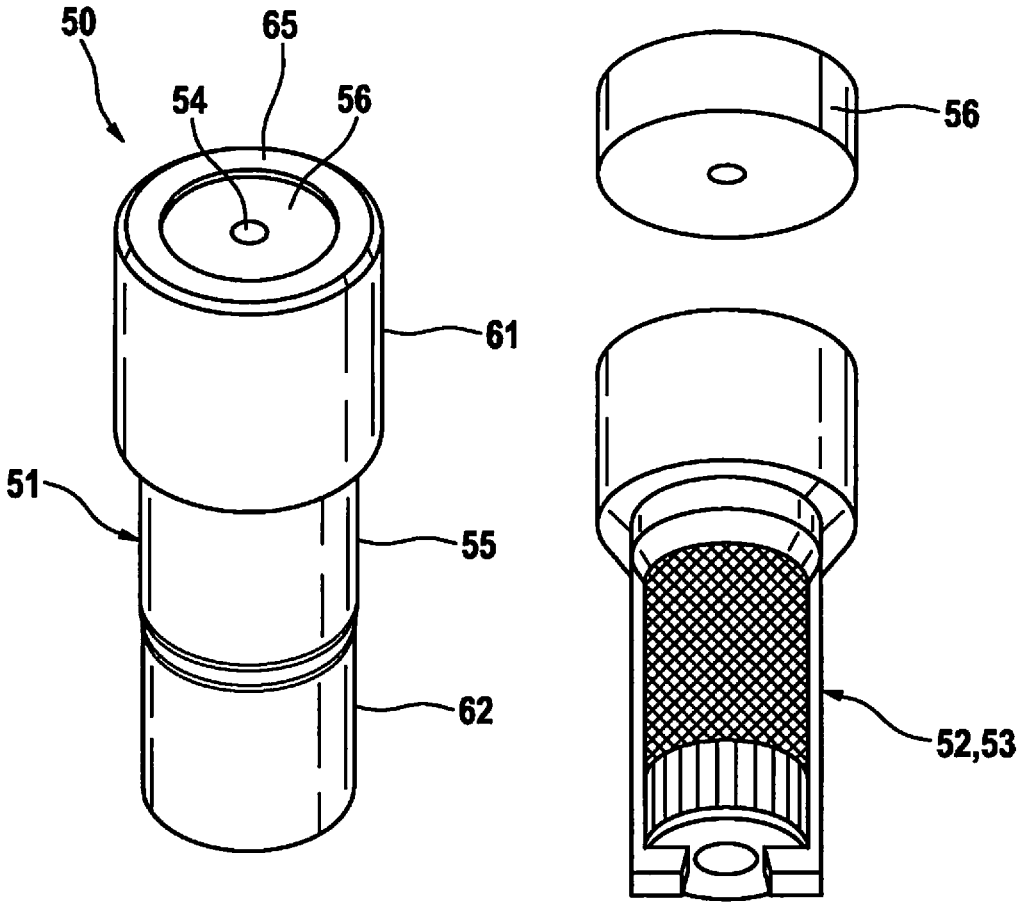
FIG. 3 shows the adjusting element in an exterior view as well as the components introduced into it in an individual representation.

FIG. 3 shows adjusting element 50 in an exterior view as well as the parts introduced into it in individual representations. This shows clearly the design of sleeve 51, including multiple areas 55, 61, 62, as seen over its axial length, having different outside diameters. The individual representations of throttle element 56 and filter element 52, 53 show that these inserted parts are able to be introduced accurately and precisely into the interior of sleeve 51 in accordance with their shape, as is already apparent from the sectional view according to FIG. 2. Throttle element 56 may ideally be a simple disk manufactured by a precision method in the outside diameter and inside diameter and having front sides extending in parallel.

Figure 4:
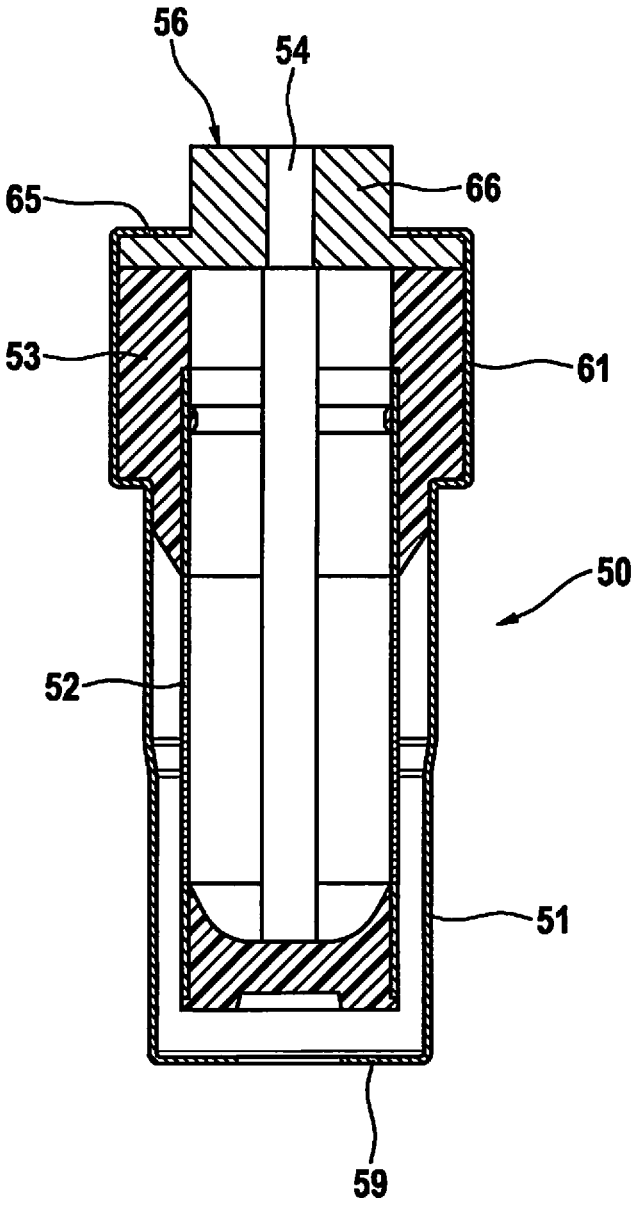
FIG. 4 shows an alternative adjusting element in a sectional view.

FIG. 4 shows an alternative adjusting element 50 in a sectional view, the differences in comparison with the exemplary embodiment shown in FIGS. 2 and 3 are in particular the length of filter element 52, 53 and the modified design of throttle element 56. Filter element 52, 53 is then introduced into sleeve 51, so that it is suspended and does not rest on bottom area 59 of deep-drawn sleeve 51. Throttle element 56 is also designed to be stepped instead of disk-shaped, but here it protrudes out of sleeve 51 beyond annular collar 65 on the inlet side. Journal-shaped section 66 protruding beyond annular collar 65 has a definitely smaller outside diameter than the outside diameter of the section of throttle element 56 lying inside sleeve 51. Throttle element 56 is thus still secured via the flanging but area 61 of sleeve 51 having a large diameter may be reduced in its axial extent. Such an approach may be particularly preferred for reasons of installation space optimization.

The present invention is not limited to the exemplary embodiments presented here and may also be implemented in a variety of other designs of fuel injectors in comparison with the fuel injector design shown in FIG. 1.

What is claimed is:

1. A fuel injector for a fuel injection system for direct injection of fuel into a combustion chamber of an internal combustion engine, the fuel injector comprising:

an actuator, energization of which permits a lifting movement of a valve needle, so that an actuation of a valve closing body, which forms a sealing seat together with a valve face, is enabled;

a fuel feed on a fuel inlet side; and an adjusting element to adjust a spring force of a return spring situated in a fuel inlet;

wherein the adjusting element is delimited toward an outside by a sleeve, and a throttle element is introduced as an independent insert into an interior of the sleeve, wherein the throttle element is situated in a radially enlarged area of the sleeve with respect to a remainder of the sleeve, wherein the radially enlarged area extends over less than half of the sleeve, wherein the throttle element protrudes out of the sleeve beyond an annular collar of the sleeve on the fuel inlet side, wherein a majority of the throttle element is situated within the radially enlarged area.

2. The fuel injector as recited in claim 1, wherein the sleeve is a thin-walled deep-drawn part.

3. The fuel injector as recited in claim 1, wherein a flow throttle in the form of a throttle borehole is in the throttle element, the throttle borehole having an opening cross section which is multiple times smaller than an opening cross section of the fuel feed.

4. The fuel injector as recited in claim 1, wherein the throttle element is designed to be stepped.

5. The fuel injector as recited in claim 1, wherein the throttle element is introduced at the inlet side into the sleeve of the adjusting element.

6. The fuel injector as recited in claim 1, wherein the throttle element is secured in the sleeve via an annular collar on the sleeve.

7. The fuel injector as recited in claim 1, wherein the sleeve has multiple areas over its axial length, each of the areas having a different outside diameter.

8. The fuel injector as recited in claim 1, wherein a filter element is integrated as an independent part into the sleeve of the adjusting element.

9. The fuel injector as recited in claim 1, wherein an element which guides the return spring is provided on the sleeve.

10. The fuel injector as recited in claim 9, wherein the element which guides the return spring is a cantilever.

11. A fuel injector for a fuel injection system for direct injection of fuel into a combustion chamber of an internal combustion engine, the fuel injector comprising:

an actuator, energization of which permits a lifting movement of a valve needle, so that an actuation of a valve closing body, which forms a sealing seat together with a valve face, is enabled;

a fuel feed on a fuel inlet side; and an adjusting element to adjust a spring force of a return spring situated in a fuel inlet;

wherein the adjusting element is delimited toward an outside by a sleeve, and a disk-shaped throttle element is introduced as an independent insert into an interior of the sleeve, wherein a filter element is integrated as a separate component in the sleeve of the adjusting element, the sleeve receiving the throttle element and the filter element in the interior thereof consecutively and configured to enclose the throttle element and the filter element in a secure and a protected manner, wherein the throttle element is configured to rest upon the filter element.

* * * * *